US006530555B1

(12) United States Patent
Stoecklein et al.

(10) Patent No.: US 6,530,555 B1
(45) Date of Patent: Mar. 11, 2003

(54) VALVE FOR CONTROLLING FLUIDS

(75) Inventors: Wolfgang Stoecklein, Stuttgart (DE); Dietmar Schmieder, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/831,603

(22) PCT Filed: Sep. 9, 2000

(86) PCT No.: PCT/DE00/03138

§ 371 (c)(1),
(2), (4) Date: May 10, 2001

(87) PCT Pub. No.: WO01/23743

PCT Pub. Date: Apr. 5, 2001

(30) Foreign Application Priority Data

Sep. 30, 1999 (DE) ..... 199 46 833

(51) Int. Cl.[7] ..... F02M 37/04
(52) U.S. Cl. ..... 251/57; 239/102.2; 123/446
(58) Field of Search ..... 251/129.06, 57; 239/96, 102.2, 585.1; 123/446

(56) References Cited

U.S. PATENT DOCUMENTS 5,758,618 A * 6/1998 Jay et al. ..... 123/299
5,779,149 A * 7/1998 Hayes, Jr. ..... 239/124
5,819,710 A * 10/1998 Huber ..... 239/96
5,875,764 A * 3/1999 Kappel et al. ..... 123/446
5,975,428 A * 11/1999 Potschin et al. ..... 239/585.1
5,979,790 A * 11/1999 Gurich et al. ..... 239/533.2
6,021,760 A * 2/2000 Boecking ..... 123/446
6,427,664 B1 * 8/2002 Boecking ..... 123/446

FOREIGN PATENT DOCUMENTS

| | | |
|---|---|---|
| DE | 196 24 001 A | 12/1997 |
| DE | 197 08 304 A | 9/1998 |
| DE | 198 03 910 A | 11/1998 |
| DE | 197 32 802 A | 2/1999 |
| DE | 197 42 943 C | 4/1999 |
| EP | 0 477 400 A | 4/1992 |
| EP | 0 816 670 A | 1/1998 |

* cited by examiner

*Primary Examiner*—Henry C. Yuen
*Assistant Examiner*—Eric Keasel
(74) *Attorney, Agent, or Firm*—Michael J. Striker

(57) ABSTRACT

A valve (1) for controlling liquids is proposed, having a piezoelectric unit (3) for actuating a valve member (2), which member is axially displaceable in a bore (8) of a valve body (9) and on one end has a valve closing member (13) that cooperates with at least one seat (14, 15), provided on the valve body (9), for opening and closing the valve (1). The valve closing member (13) divides a low-pressure region (16) having a system pressure (p_sys) from a high-pressure region (17). To compensate for a leakage quantity from the low-pressure region (16) by drawing hydraulic liquid from the high-pressure region (17), a filling device (26) is provided, which is embodied with a conduit (27) having a throttle bore (28). The diameter of the throttle bore is designed such that a volumetric flow that from the high-pressure region (17), which flow passes through the throttle bore (28), at a defined minimum high pressure (p_R_min) compensates for the leakage quantity from the low-pressure region (16) (FIG. 1).

8 Claims, 2 Drawing Sheets

VALVE FOR CONTROLLING FLUIDS

BACKGROUND OF THE INVENTION

The invention relates to a valve for controlling liquids.

From European Patent Disclosure EP 0 477 400 A1, such a valve is already known which is actuatable via a piezoelectric actuator. This known valve has an arrangement for a travel transformer of the piezoelectric actuator, effective in the stroke direction, in which the deflection of the piezoelectric actuator is transmitted via a hydraulic chamber that functions as a hydraulic step-up means or coupling and tolerance compensation element.

The hydraulic chamber encloses a common compensation volume between two pistons defining this chamber, of which one piston is embodied with a smaller diameter and is connected to a valve member to be triggered, and the other piston is embodied with a larger diameter and is connected to the piezoelectric actuator. The hydraulic chamber is fastened between the two pistons in such a way that the actuating piston of the valve member, which piston is retained in its position of repose by means of one or more springs relative to a predetermined position, executes a stroke that is increased by the step-up ratio of the piston diameter when the larger piston is moved a certain travel distance by the piezoelectric actuator. The valve member, piston and piezoelectric actuator are located one after the other on a common axis. Via the compensation volume of the hydraulic chamber, tolerances caused by temperature gradients in the component or different coefficients of thermal expansion of the materials used and possible settling effects can be compensated for without causing a change in position of the valve member to be triggered.

The hydraulic coupler requires a system pressure, which drops because of leakage if adequate refilling with hydraulic liquid is not done.

In the industry, in common rail injectors, versions are known in which the system pressure is expediently generated in the valve itself, and a constant system pressure is assured even upon system starting. To that end, hydraulic liquid is drawn from a high-pressure region of the fuel to be controlled and delivered to the low-pressure region at the system pressure. This is done with the aid of leakage gaps, which are defined by leakage or filling pins.

However, if the pressure in the high-pressure region rises, the leakage rate in the system region automatically increases. Under some circumstances, the result is an impermissible high leakage loss from the valve, which severely reduces the efficiency of the system.

The object of the invention is to create a valve for controlling liquids with which the leakage losses at increasing pressure in the high-pressure region are limited.

SUMMARY OF THE INVENTION

The valve according to the invention for controlling liquids has the advantage that to generate the minimum leakage rate from the high-pressure region into the low-pressure region at system pressure, a throttle bore is used, and thus the leakage loss at high pressures in the high-pressure region is reduced by multiple times compared with the system pressure supply through a conventional leakage gap or filling pin.

In a simple way, the fundamentally different physical flow effects between the turbulent flow through a throttle bore and the laminar gap flow around a filling pin are utilized to realize the filling of the low-pressure region.

Further advantages and advantageous features of the subject of the invention can be learned from the specification, drawing and claims.

BRIEF DESCRIPTION OF THE DRAWINGS

An exemplary embodiment of the valve of the invention for controlling liquids is shown in the drawing and described in further detail in the ensuing description. Shown are FIG. 1, a schematic, fragmentary view of a first exemplary embodiment of the invention in a fuel injection valve for internal combustion engines, in longitudinal section.

DESCRIPTION OF THE PREFERRED EMBODIMENTS

Figure 1:
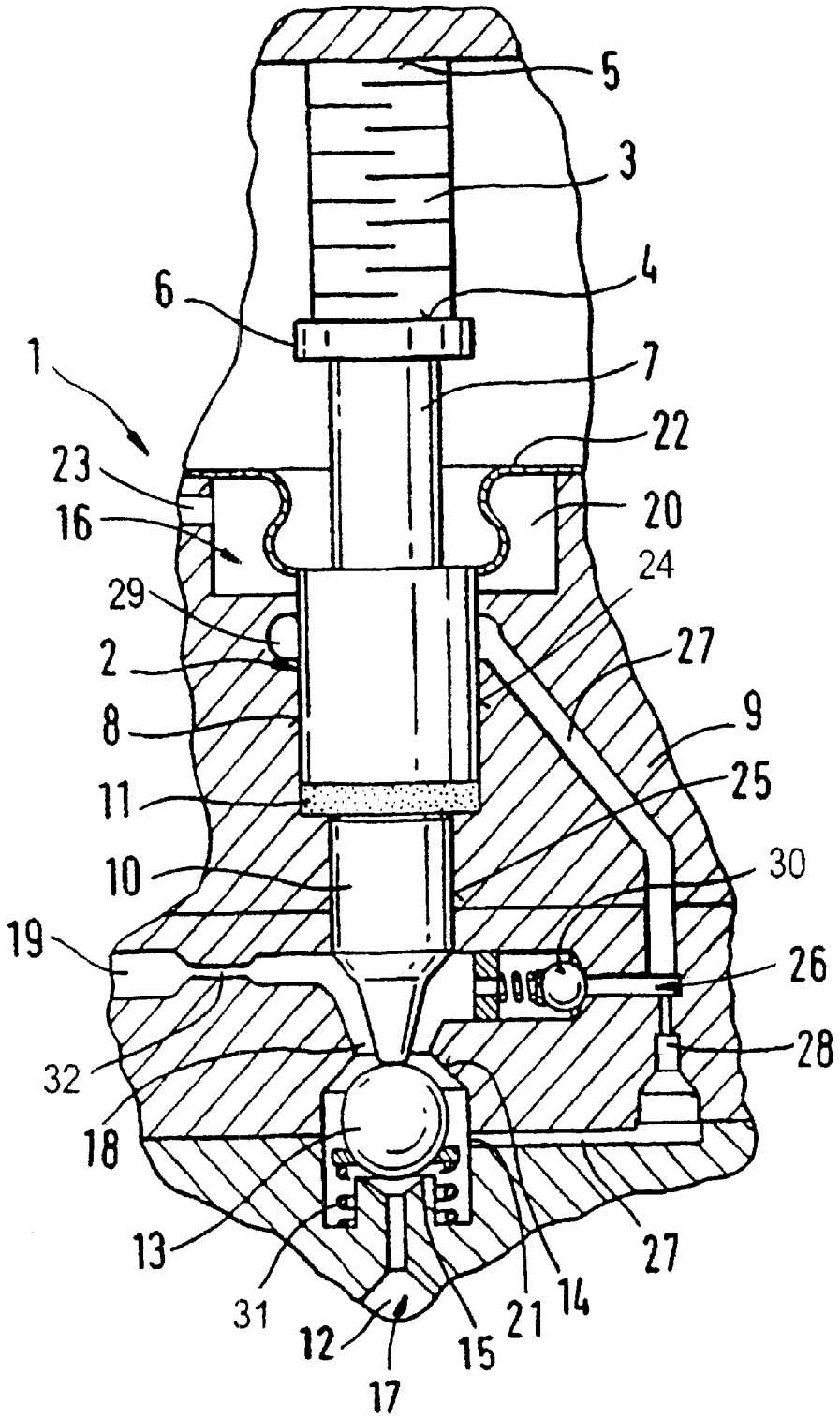
Figure 2:
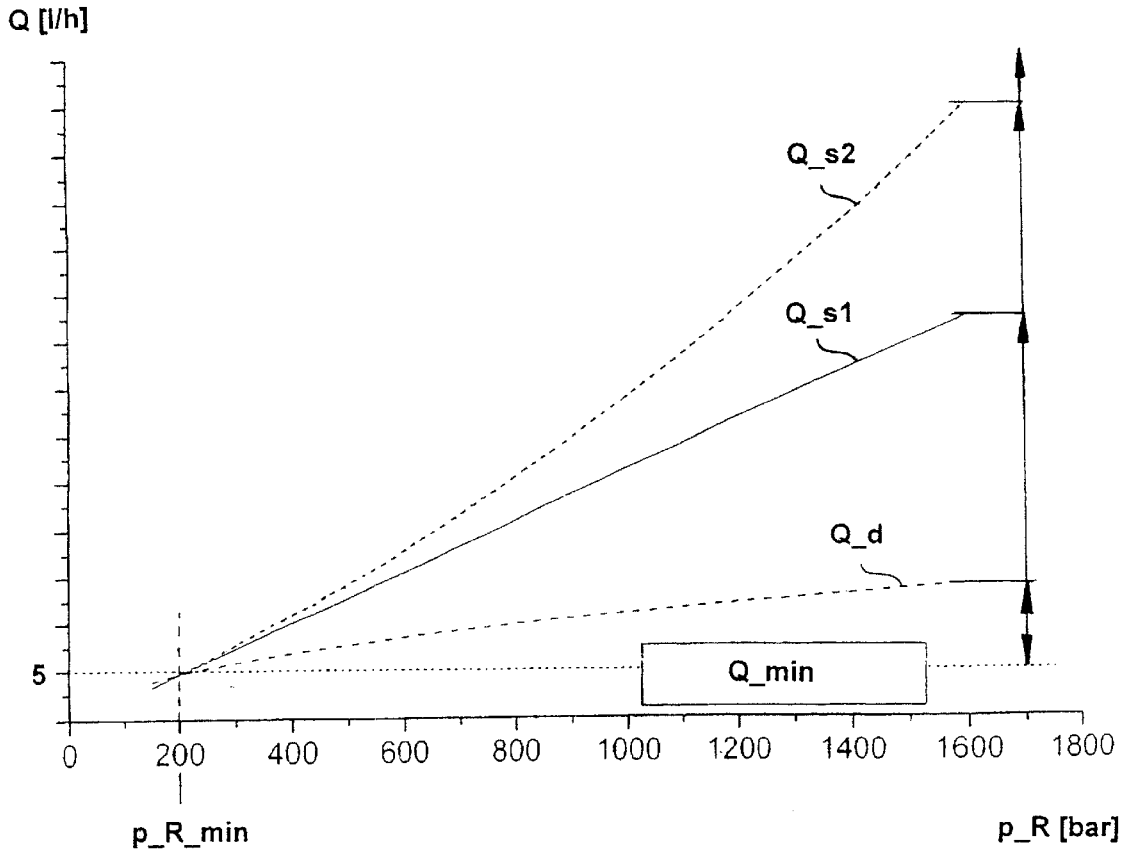
FIG. 2, a diagram showing a highly simplified course of a pressure-dependent leakage quantity in a throttle bore according to the invention, in comparison with the pressure-dependent leakage quantity with a filling pin.

The exemplary embodiment shown in FIG. 1 illustrates a use of the valve of the invention in a fuel injection valve 1 for internal combustion engines of motor vehicles. The fuel injection valve 1 is embodied here as a common rail injector, and the fuel injection is controlled via the pressure level in a valve control chamber 12, which is connected to a high-pressure supply.

For setting an injection onset, injection duration, and injection quantity via force ratios in the fuel injection valve 1, a multiple-piece valve member 2 is triggered via a piezoelectric unit, embodied as a piezoelectric actuator 3 and disposed on the side of the valve member 2 toward the valve control chamber and the combustion chamber.

The piezoelectric actuator 3 is made up of multiple layers, and on its side toward the valve member 2 it has an actuator head 4 and on its side remote from the valve member it has an actuator foot 5, which is braced on a wall of a valve body 9. Via a bearing 6, a first piston 7, embodied with a stepped diameter, of the valve member 2 rests on the actuator head 4.

The valve member 2 is disposed axially displaceably in a bore 8, embodied as a longitudinal bore, of the valve body 9 and along with the first piston 7 also has a second piston 10 that actuates a valve closing member 13; the pistons 7 and 10 are coupled to one another by a hydraulic step-up means.

The hydraulic step-up means is embodied as a hydraulic chamber 11, which transmits the deflection of the piezoelectric actuator 3. Between the two pistons 7 and 10 defining it, of which the second piston 10 is embodied with a smaller diameter and the first piston 7 is embodied with a larger diameter, the hydraulic chamber 11 encloses a common compensation volume.

The hydraulic chamber 11 is fastened between the pistons 7 and 10 in such a way that the second piston 10 of the valve member 2 executes a stroke that is lengthened by the step-up ratio of the piston diameter when the larger first piston 7 is moved a certain travel distance by the piezoelectric actuator 3. The valve member 2, the pistons 7 and 10, and the piezoelectric actuator 3 are located one after the other on a common axis.

Via the compensation volume of the hydraulic chamber 11, tolerances from temperature gradients or different coefficients of thermal expansion of the materials used and possible settling effects can be compensated for, without causing any change in the position of the valve closing member 13 to be triggered.

On the end of the valve member 2 toward the valve control chamber, the spherical valve closing member 13 cooperates with valve seats 14, 15 embodied on the valve body 9; the valve closing member 13 divides a low-pressure region 16 at a system pressure p_sys from a high-pressure region 17 at a high pressure or rail pressure p_R.

The valve seats 14, 15 are embodied in a low-pressure valve chamber 18 formed by the valve body 9; leading away from this chamber are a leak drainage conduit 19 and an opening 21 that leads to a valve system pressure chamber 20 on the side of the valve member 2 toward the piezoelectric actuator 3.

The valve low-pressure chamber 18 furthermore has a communication, formed by the lower valve seat 15, with the valve control chamber 12, merely indicated in FIG. 1, in the high-pressure region 17. A movable valve control piston, not further shown in the drawing, is disposed in the valve control chamber 12. By axial motions of the valve control piston in the valve control chamber 12, which typically communicates with an injection line that communicates with a high-pressure storage chamber (common rail) that is common to a plurality of fuel injection valves and supplies an injection nozzle with fuel, the injection performance of the fuel injection valve 1 is controlled in a manner known per se.

The valve system pressure chamber 20 adjoins the end of the bore 8 toward the piezoelectric actuator and is defined on one side by the valve body 9 and on the other by a sealing element 22, connected to the first piston 7 of the valve member 2 and to the valve body 9; a leakage line 23 leads away from the valve system pressure chamber 20. The sealing element 22 in this case is embodied as a bellowslike diaphragm and prevents the piezoelectric actuator 3 from coming into contact with the fuel contained in the valve system pressure chamber 20.

Via a gap 24 surrounding the first piston 7 and a gap 25 surrounding the second piston 10, leakage from the hydraulic chamber 11 exists into the valve low-pressure chamber 18 and in particular into the valve system pressure chamber 20.

Since the hydraulic chamber 11 must be refilled during an interval in triggering or supplying current to the piezoelectric actuator 3, compensation for a leakage quantity from the low-pressure region 16 is provided for by withdrawing hydraulic liquid from the high-pressure region 17. For this purpose, a filling device 26 is used that is embodied with a conduit 27 in which a throttle bore 28 is disposed. The conduit 27 of the filling device 26 discharges, on the side of the throttle bore 28 toward the low-pressure region 16, into the gap 24 surrounding the first piston 7, and an annular groove 29 is provided in the discharge region. On the side of the throttle bore 28 toward the high-pressure region 17, the conduit 27 discharges into the valve low-pressure chamber 18.

Naturally in an alternative version it may also be provided that the conduit 27 of the filling device 26 lead to the gap 25 surrounding the second piston 10.

The diameter of the throttle bore 28 is designed such that a volumetric flow that passes through the throttle bore 28 and comes from the high-pressure region 17 compensates, at a defined minimum high pressure p_R_min, for the leakage quantity from the low-pressure region 16. In the version shown, the throttle bore 28 has a diameter of 50 micrometers.

Between the throttle bore 28 and the point of discharge of the conduit 27 into the annular gap 29, a communication between the conduit 27 of the filling device 28 and the valve low-pressure chamber 18 is also provided, via an overpressure valve 30, which is spring-loaded. This overpressure valve 30 serves to set a constant system pressure p_sys in the valve system pressure chamber 20, so that the system pressure can be kept the same for all the common rail injectors belonging together.

The fuel injection valve 1 of FIG. 1 functions as follows.

In the closed state of the fuel injection valve 1, that is, when the piezoelectric actuator 3 has no electric current, the valve closing member 13 of the valve member 2 is kept in contact with the upper valve seat 14 assigned to it, by means of the high pressure or rail pressure p_R in the high-pressure region 17, so that no fuel from the valve control chamber 12 communicating with the common rail can reach the valve low-pressure chamber 18 and then escape through the leak drainage conduit 19.

Upon relief of the valve control chamber 12, the valve closing member 13 is kept on the upper valve seat 14 by a spring 29.

In the event of a slow actuation, as occurs upon a temperature-dictated change in length of the piezoelectric actuator 3 or other valve components, such as the valve member 2 or the valve body 9, the first piston 7 upon an increase in temperature penetrates the compensation volume of the hydraulic chamber 11, or upon a temperature drop retracts from it, without this having any overall effects on the closing and opening position of the valve member 2 and of the fuel valve 1.

If an injection through the fuel injection valve 1 is to take place, the piezoelectric actuator 3 is supplied with current, which causes it to increase its axial length abruptly. Upon this kind of fast actuation of the piezoelectric actuator 3, the piezoelectric actuator is braced on the valve body 9 acting as a counterpart bearing, and as a result the second piston 10 moves the valve closing member 13 of the valve member 2 from its upper valve seat 14 into a middle position between the two valve seats 14, 15. By the control motion of the valve member 2, because of the moving diaphragm 22, the volume of the valve system pressure chamber 20 is decreased, and a pressure drop takes place by leakage from the hydraulic chamber into the valve system pressure chamber 20 and the valve low-pressure chamber 18 and from the latter via the leakage line 23 and the leak drainage conduit 19 as well as well the overpressure valve 30.

After the pressure exceeding the system pressure p_sys in the low-pressure region 16 has been bled off, the valve closing member 13 can be moved into its closing position on the lower valve seat 15, and as a result no further fuel from the valve control chamber 12 reaches the valve low-pressure chamber 18. The fuel injection is thus terminated again.

After that, the current supply to the piezoelectric actuator 3 is interrupted, causing the piezoelectric actuator to become shorter again, and the valve closing member 13 is brought to the middle position between the two valve seats 14, 15, and another fuel injection takes place. Fuel can enter the valve low-pressure chamber 18 through the lower valve seat. The pressure is not reduced immediately, however, because of a throttle 32 disposed in the leak drainage conduit 19. The brief pressure increase in the valve low-pressure chamber 18 creates a hydraulic counterforce, which slows down the control motion of the valve member 2 in such a way that the valve closing member 13 is stabilized in its middle position between the two valve seats 14, 15.

After the pressure reduction in the valve low-pressure chamber 18 through the leak drainage conduit 19, the valve member 13 moves into its closing position on the upper valve seat 14. Thus upon each triggering (delivery of current or termination of current delivery) of the piezoelectric unit, a fuel injection is made possible.

When the valve closing member 13 is lifted from its lower valve seat 15, high pressure p_R from the valve control chamber 12 is delivered to the conduit 27 of the filling device 26, so that the leakage losses in the low-pressure region 16 can be compensated for.

Since a certain system pressure p_sys is always required, the throttle bore 28 must,be dimensioned such that furnishing the system pressure p_sys is still assured even at a minimum high pressure p_R_min. On the other hand, as the high pressure or rail pressure p_R increases, the leakage into the low-pressure region 16 increases as well. The overpressure valve 30 therefore opens wider, the higher the high pressure p_R delivered to the conduit 27, so that excess hydraulic liquid or fuel can be drained off in order to maintain the constant system pressure p_sys.

In FIG. 3, a graph is provided which shows that the throttle bore 28 has pronounced advantages over the achievement of filling of the low-pressure region 16 using a conventional filling pin.

In the graph, a course of a pressure-dependent leakage quantity Q_d for the throttle bore 28 of the invention is plotted in comparison with a pressure-dependent leakage quantity Q_s1 with a filling pin without gap widening and in comparison with a pressure-dependent leakage quantity Q_s2 for a filling pin with gap widening.

To enable the system pressure p_sys to be maintained, the leakage through the throttle bore 28 must already be greater at even a relatively low high pressure p_R, for instance of 200 bar, than the losses from the low-pressure region 16, and as a result the minimum flow Q_min of 5 liters per hour, in this case, thus results.

The courses of the flow quantities show that the flow quantity Q_d through the throttle bore 28 when the pressure p_R is increasing does not increase to the same extent as with a filling pin. If the differences in flow quantities are expressed in terms of an equation, then the volumetric flow Q_d through the throttle bore 28 can be written as follows, if the numerous factors to be taken into account besides the pressure difference are reduced to a single flow factor A:

$$Q_d(p)=A\sqrt{(p_R-p_sys)}$$

As the high pressure or rail pressure p_R increases, the flow and thus the excess quantity that is drained off through the overpressure valve 30 increase only in terms of the root. Conversely, filling of the low-pressure region 16 with a filling pin can be written in the form of the following equation, with a simplified flow factor B:

$$Q_s(p)=B(p_R-p_sys)$$

The equation is linear with regard to the pressure difference. The flow Q_s thus increases in linear fashion, given high rail pressure p_R.

While filling with a filling pin and filling with a throttle bore at a high pressure p_R of 200 bar still both produce the same requisite minimum quantity of inflow to the low-pressure region 16, by comparison the filling pin, even without gap widening, generates a considerably greater leakage quantity Q_s1 than the throttle bore as the high pressure p_R rises. If it is also considered in the case of the filling pin that the leakage gap is additionally widened by the high pressure p_R, as indicated by the course of the volumetric flow Q_s2, filling with the throttle bore 28 proves to be still more favorable in terms of the efficiency of the overall system.

We claim:

1. A valve for controlling liquids, comprising:

a piezoelectric unit (3) for actuating a valve member (2), wherein said member is axially displaceable in a bore (8) of a valve body (9) and on one end has a valve closing member (13) that cooperates with at least one seat (14, 15) provided on the valve body (9), wherein a low-pressure region having a hydraulic chamber with a system pressure is dividable by the valve closing member from a high-pressure region (17), wherein a filling device (26) is provided to compensate for a leakage quantity from the hydraulic chamber of the low-pressure region (16) by drawing hydraulic liquid from the high-pressure region (17), wherein, for compensating for said leakage quantity, the filling device (26) includes a filling device conduit (27) having a throttle bore (28), wherein said throttle bore has a diameter such that a volumetric flow that passes from the high-pressure region (17) through the throttle bore (28) at a defined minimum high pressure (p_R_min) compensates the leakage quantity, wherein said throttle bore discharges into a gap surrounding the valve member, and wherein a region of the filling device conduit between the throttle bore and an end toward the gap surrounding the valve member is connected by an overpressure valve opening to the valve low-pressure chamber for setting the system pressure.

2. The valve for controlling liquids of claim 1, wherein the throttle bore (28) has a diameter of approximately 40 micrometers to 60 micrometers.

3. The valve for controlling liquids of claim 1, wherein the valve member (2) has a split form with at least one first piston (7) and one second piston (10), wherein said at least one first piston (7) and one second piston (10) are separated from one another by a hydraulic chamber (11), wherein the at least one first piston (7) borders on the piezoelectric unit (3) and is surrounded by a valve system pressure chamber (20) with a leakage line in a region adjoining the bore (8) of the valve body (9), wherein the second piston (10) borders on the valve low-pressure chamber (18) that has a valve. seat (14, 15) and a leak drainage conduit (19).

4. The valve for controlling liquids of claim 3, wherein the filling device conduit (27), on a side of the throttle bore (28) toward the low-pressure region (16), discharges into the gap (24) surrounding the first piston (7).

5. The valve for controlling liquids of claim 3, wherein the valve closing member (13) cooperates with two valve seats (14, 15) disposed in the valve low-pressure chamber (18) for opening and closing the valve (1) in such a way that in a closed position, said valve closing member (13) divides the valve low-pressure chamber (18) from a valve control chamber (12) that is at high pressure, and in an intermediate position between the valve seats (14, 15), said valve closing member (13) fluidly connects the valve low-pressure chamber (18) with the valve control chamber (12).

6. The valve for controlling liquids of claim 3, wherein the hydraulic chamber (11) at system pressure (p_sys) is a tolerance compensation element for compensating for changes in elongation of the piezoelectric unit (3) and is formed as a hydraulic step-up means.

7. The valve for controlling liquids of claim 3, wherein the valve system pressure chamber (20) is defined by a sealing element (22).

8. The valve for controlling liquids of claim 7, wherein the sealing element defining the valve system pressure chamber (20) is embodied as a diaphragm (22), wherein said diaphragm is connected in such a way to the valve member (2) and the valve body (9) that the piezoelectric unit (3) is protected against contact with the liquid to be controlled.

* * * * *